US010598146B2

(12) United States Patent
Iida et al.

(10) Patent No.: US 10,598,146 B2
(45) Date of Patent: Mar. 24, 2020

(54) HYDRAULIC PUMP-MOTOR

(71) Applicant: Komatsu Ltd., Tokyo (JP)

(72) Inventors: Takeo Iida, Koga (JP); Mitsuru Arai, Yokohama (JP); Seiichi Hasegawa, Oyama (JP)

(73) Assignee: KOMATSU LTD., Tokyo (JP)

( * ) Notice: Subject to any disclaimer, the term of this patent is extended or adjusted under 35 U.S.C. 154(b) by 326 days.

(21) Appl. No.: 15/306,313

(22) PCT Filed: Aug. 8, 2014

(86) PCT No.: PCT/JP2014/071104
§ 371 (c)(1),
(2) Date: Oct. 24, 2016

(87) PCT Pub. No.: WO2016/021072
PCT Pub. Date: Feb. 11, 2016

(65) Prior Publication Data
US 2017/0045028 A1 Feb. 16, 2017

(51) Int. Cl.
*F03C 1/40* (2006.01)
*F04B 1/14* (2020.01)
(Continued)

(52) U.S. Cl.
CPC ..... *F03C 1/0686* (2013.01); *F03C 1/0605* (2013.01); *F03C 1/0626* (2013.01);
(Continued)

(58) Field of Classification Search
CPC ..... F04B 1/2042; F04B 1/22; F04B 49/22; F04B 1/124; F04B 1/143; F04B 1/146;
(Continued)

(56) References Cited

U.S. PATENT DOCUMENTS 8,047,120 B2 11/2011 Shinohara et al.
8,734,127 B2 5/2014 Iida
(Continued)

FOREIGN PATENT DOCUMENTS

CN 1892032 A 1/2007
CN 101115922 A 1/2008
(Continued)

OTHER PUBLICATIONS

International Search Report dated Nov. 11, 2014, issued for PCT/JP2014/071104.

*Primary Examiner* — Dominick L Plakkoottam
(74) *Attorney, Agent, or Firm* — Locke Lord LLP

(57) ABSTRACT

An axial hydraulic pump-motor, in which a cylinder block having a plurality of cylinder bores on a valve plate having a high-pressure side port and a low-pressure side port for controlling an amount of reciprocation of a piston in each of the cylinder bores, the hydraulic pump-motor includes: a residual pressure release port provided on the valve plate and communicating until the cylinder bore on a top dead center side communicates with the low-pressure side port; a residual pressure acquisition portion obtaining a value of a residual pressure in the cylinder bore on the top dead center side; and a directional switching valve switching a flow path between the residual pressure release port and an hydraulic oil tank and a flow path between the residual pressure release port and the low-pressure side port.

6 Claims, 13 Drawing Sheets

(51) Int. Cl.

| | |
|---|---|
| ***F03C 1/28*** | (2006.01) |
| ***F04B 49/22*** | (2006.01) |
| ***F03C 1/06*** | (2006.01) |
| ***F03C 1/32*** | (2006.01) |
| ***F04B 1/12*** | (2020.01) |
| ***F04B 1/29*** | (2020.01) |
| ***F04B 1/22*** | (2006.01) |
| ***F04B 1/303*** | (2020.01) |
| ***F04B 1/2042*** | (2020.01) |
| ***F03C 1/34*** | (2006.01) |
| ***F04B 1/124*** | (2020.01) |
| ***F04B 1/143*** | (2020.01) |
| ***F04B 1/146*** | (2020.01) |

(52) U.S. Cl.
CPC ..... *F03C 1/0631* (2013.01); *F03C 1/0655* (2013.01); *F03C 1/0678* (2013.01); *F04B 1/124* (2013.01); *F04B 1/143* (2013.01); *F04B 1/146* (2013.01); *F04B 1/2042* (2013.01); *F04B 1/22* (2013.01); *F04B 1/29* (2013.01); *F04B 1/303* (2013.01); *F04B 49/22* (2013.01)

(58) Field of Classification Search
CPC ..... F04B 1/188; F04B 1/2021; F04B 1/2035; F04B 1/29; F04B 1/303; F04B 1/324
See application file for complete search history.

(56) References Cited

U.S. PATENT DOCUMENTS

| | | | | |
|---|---|---|---|---|
| 2008/0138225 | A1* | 6/2008 | Shinohara | F04B 1/2021 417/559 |
| 2010/0236398 | A1* | 9/2010 | Iida | F04B 1/188 91/499 |

FOREIGN PATENT DOCUMENTS

| | | | |
|---|---|---|---|
| CN | 101802401 | A | 8/2010 |
| EP | 2199609 | A2 | 6/2010 |
| JP | 51-071503 | A | 6/1976 |
| JP | 55-152369 | U | 11/1980 |
| JP | 62-139983 | A | 6/1987 |
| JP | 02-014475 | U | 1/1990 |
| JP | 08-284805 | A | 10/1996 |
| JP | 09-280159 | A | 10/1997 |
| JP | 2000-064950 | A | 3/2000 |
| JP | 2014-111914 | A | 6/2014 |

* cited by examiner (WHEN RESIDUAL PRESSURE IS SMALL)

(WHEN RESIDUAL PRESSURE IS MEDIUM)

(WHEN RESIDUAL PRESSURE IS GREAT)

HYDRAULIC PUMP-MOTOR

FIELD

The present invention relates to an axial hydraulic pump-motor (hydraulic pump or hydraulic motor) capable of reducing erosion and noise caused by aeration produced when transiting from a high-pressure process to a low-pressure process and increasing a rotation efficiency.

BACKGROUND

Conventionally, in construction machines and the like, an axial hydraulic piston pump driven by an engine and an axial hydraulic piston motor driven by a high-pressure hydraulic oil have been widely used.

For example, the axial hydraulic piston pump includes a cylinder block, a plurality of pistons, and a valve plate. In the cylinder block, a plurality of cylinders are provided so as to rotate together with a rotational shaft rotatably provided in a case, extending in the axial direction, and separated from each other in the circumferential direction. The pistons are slidably inserted into the respective cylinders of the cylinder block and move in the axial direction along with the rotation of this cylinder block to suck and discharge the hydraulic oil. The valve plate is provided between the case and an end surface of the cylinder block. A suction port and a discharge port communicating with the respective cylinders are formed on the valve plate. In the hydraulic pump, when a driving shaft is driven and rotated, the cylinder block rotates together with an operating shaft in the case, and the pistons reciprocate in the respective cylinders of the cylinder block. The hydraulic oil sucked into the cylinders from the suction port is pressurized by the pistons and is discharged from the discharge port as high-pressure hydraulic oil.

Herein, a suction process is conducted in which, when a cylinder port of each cylinder communicates with the suction port of the valve plate, the pistons move in the direction in which the pistons protrude from the cylinders from the start point to the end point of the suction port to suck the hydraulic oil into the cylinders from the suction port. On the other hand, a discharge process is conducted in which, when the cylinder port of each cylinder communicates with the discharge port, the pistons move in a direction in which the pistons enter the cylinders from the start point to the end point of the discharge port to discharge the hydraulic oil in the cylinders into the discharge port. By rotating the cylinder block so as to repeat the suction process and the discharge process, the hydraulic oil sucked from the suction port into the cylinder at the suction process is configured to be pressurized at the discharge process and discharged to the discharge port.

CITATION LIST

Patent Literature

Patent Literature 1: Japanese Laid-open Patent Publication No. 2000-64950

SUMMARY

Technical Problem

Meanwhile, in the above conventional hydraulic pump and the like, an inside of the cylinders, from which the hydraulic oil is discharged via the discharge port of the valve plate in the discharge process, is highly pressurized. When the cylinder port of each cylinder is in communication with the suction port, the hydraulic oil highly-pressurized in the cylinder rapidly flows into the less pressurized suction port, and thus a large pressure fluctuation is generated. As a result of this, an aeration occurs in which air in a fine bubble state is mixed in the hydraulic oil in the suction port. The aeration causes an erosion and noise, and also reduces the efficiency.

For this reason, for example, in a configuration of Patent Literature 1, a residual pressure release hole is provided to return the highly-pressurized hydraulic oil in the cylinder to the suction port when a process changes from the discharge process to the suction process. Hereby, a change in the hydraulic oil when a process shifts from the discharge process to the suction process becomes modest, thus making a pressure of the hydraulic oil in the cylinder be identical to a pressure of the hydraulic oil pressure in the suction port when the cylinder port communicates with the suction port.

However, the residual pressure release hole is directly in communication with the suction port. In this case, an aeration occurs in the hydraulic oil removed from the inside of the cylinder via the residual pressure release hole. Then, the hydraulic oil subject to the aeration directly returns to the suction port. Therefore, due to the aeration, an erosion and a noise occur.

On the other hand, when a process shifts from the discharge process to the suction process and when the residual pressure in the cylinder is high, a rotation of the cylinder block is supposed to be assisted, and thus a rotation efficiency improves. Alternatively, when the residual pressure in the cylinder decreases along with the rotation, it is necessary to prevent the erosion in the cylinder and to improve the rotation efficiency by sucking the hydraulic oil from the suction port into the cylinder so that the pressure of the hydraulic oil in the cylinder is equal to the pressure of the hydraulic oil in the suction port.

However, when a highly precise residual-pressure control is attempted in the cylinder, the residual pressure in the cylinder has to be obtained precisely.

The present invention has been made in view of the above and an object of the present invention is to provide an axial hydraulic pump-motor capable of reducing an erosion and a noise, which are caused by an aeration occurred when a process shifts from the high-pressure process to the low-pressure process, and improving the rotation efficiency.

Solution to Problem

To solve the above problem and attain the object, according to one aspect of the present invention, there is provided an axial hydraulic pump-motor, in which a cylinder block having a plurality of cylinder bores formed around a rotational shaft slides on a valve plate having a high-pressure side port and a low-pressure side port for controlling an amount of reciprocation of a piston in each of the cylinder bores based on a tilt of a swash plate, the hydraulic pump-motor including: a residual pressure release port provided on the valve plate and configured to communicate until the cylinder bore on a top dead center side communicates with the low-pressure side port; a residual pressure acquisition portion configured to obtain, by actual measurement or estimation, a value of a residual pressure in the cylinder bore on the top dead center side while the cylinder bore on the top dead center side communicates with the low-pressure side port; and a directional switching valve configured to switch and block a flow path between the residual pressure release port and a hydraulic oil tank and a flow path between the residual pressure release port and the low-pressure side port based on the value of the residual pressure obtained by the residual pressure acquisition portion.

According to another aspect of the present invention, in the above hydraulic pump-motor, the directional switching valve has a flow-rate-adjusting mechanism.

According to another aspect of the present invention, in the above hydraulic pump-motor, the residual pressure acquisition portion includes: a residual pressure port provided on the cylinder block, the residual pressure port being a sliding surface between the cylinder block and the valve plate, the residual pressure port having an opening outside a rotation transition area of the cylinder bore, and the residual pressure port communicating with an inside of the cylinder bore; and a residual pressure detection port provided on the valve plate, the residual pressure detection port communicating with the residual pressure port temporarily via the opening of the residual pressure port along with a rotation of the cylinder block for detecting and maintaining the residual pressure in the cylinder bore on the top dead center side. Further, the directional switching valve switches and blocks the flow path based on the residual pressure as a control signal pressure maintained by the residual pressure detection port.

According to another aspect of the present invention, in the above hydraulic pump-motor, the directional switching valve is integrally formed in the valve plate.

According to another aspect of the present invention, in the above hydraulic pump-motor, the residual pressure acquisition portion is a detecting portion detecting one or more values of at least one of a swash plate angle, a rotation speed, a discharge pressure, and a hydraulic oil temperature, and is a controller estimating the residual pressure in the cylinder bore on the top dead center side based on the one or more values and generating the control signal pressure of the directional switching valve based on the estimated residual pressure.

According to another aspect of the present invention, in the above hydraulic pump-motor, when the value of the residual pressure is greater than a first predetermined value, the directional switching valve makes the residual pressure release port and the hydraulic oil tank communicate therebetween, when the value of the residual pressure is between the first predetermined value and a second predetermined value which is less than the first predetermined value, the directional switching valve blocks between the residual pressure release port and the hydraulic oil tank and blocks between the residual pressure release port and the low-pressure side port, and when the value of the residual pressure is less than the second predetermined value, the directional switching valve makes the residual pressure release port communicate with the low-pressure side port.

Advantageous Effects of Invention

According to the present invention, the hydraulic pump-motor includes a residual pressure release port provided on the valve plate and configured to communicate until the cylinder bore on a top dead center side communicates with the low-pressure side port; and a residual pressure acquisition portion configured to obtain, by actual measurement or estimation, a value of a residual pressure in the cylinder bore on the top dead center side while the cylinder bore on the top dead center side communicates with the low-pressure side port. Based on the value of the residual pressure obtained by the residual pressure acquisition portion, a directional switching valve switches and blocks a flow path between the residual pressure release port and a hydraulic oil tank and a flow path between the residual pressure release port and the low-pressure side port. The residual pressure acquisition portion obtains accurate residual pressure. Thus, it is possible to reduce erosion and noise caused by aeration produced when transiting from a high-pressure process to a low-pressure process and increasing a rotation efficiency.

DESCRIPTION OF EMBODIMENTS

Hereafter, a hydraulic pump-motor according to an aspect of carrying out the present invention will be explained with reference to the drawings.

First Embodiment

Overall Configuration of Hydraulic Pump

Figure 1:
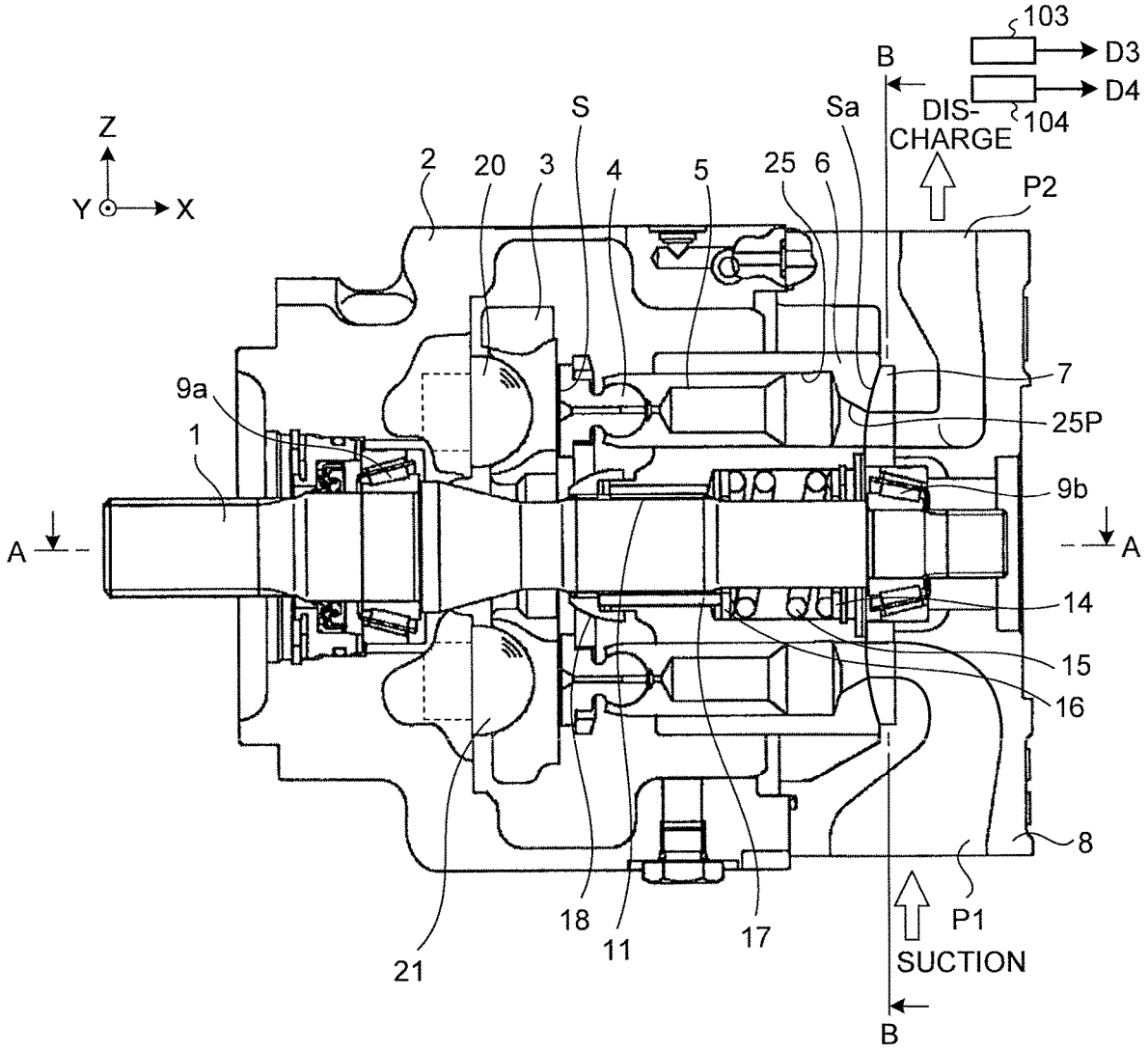
FIG. 1 is a cross-sectional view illustrating an overall configuration of a hydraulic pump according to a first embodiment of the present invention.
Figure 2:
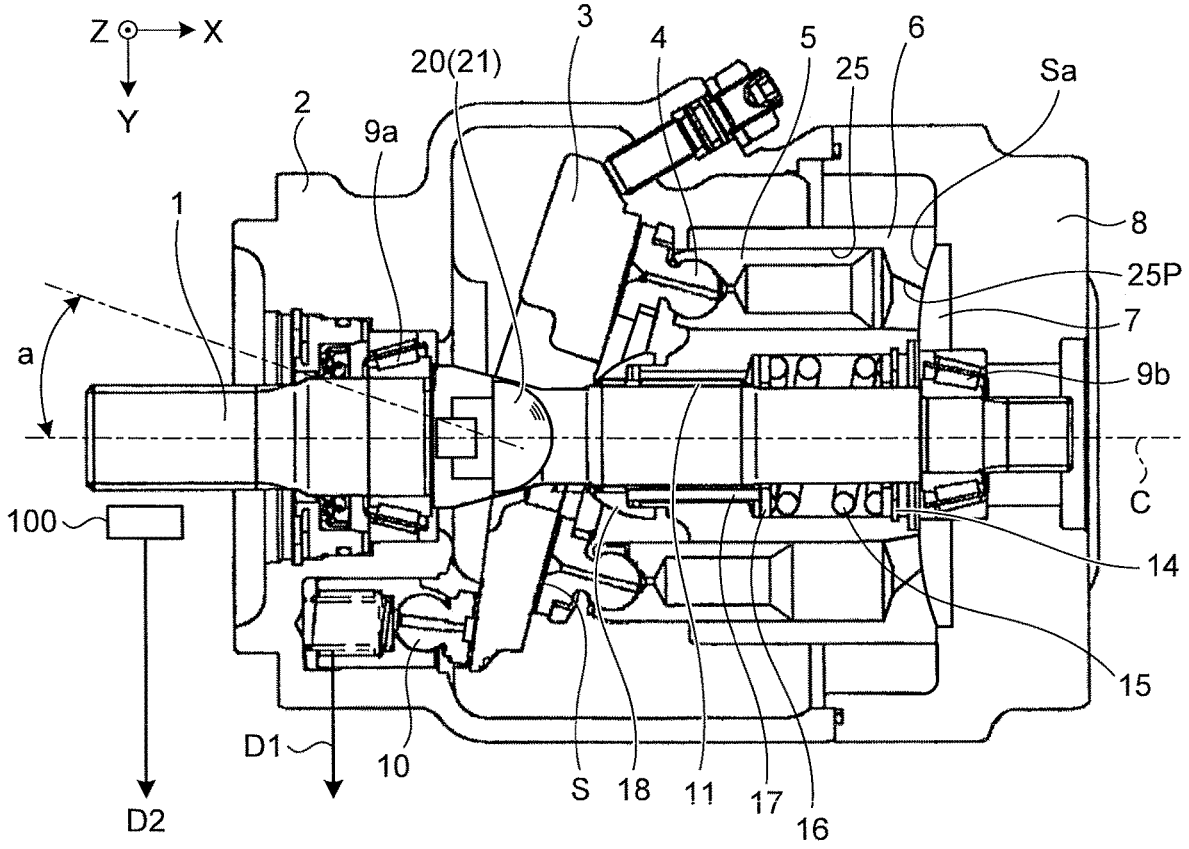
FIG. 2 is a cross-sectional view taken from a line A-A of the hydraulic pump illustrated in FIG. 1.

FIG. 1 is a cross-sectional view illustrating an overall configuration of a hydraulic pump according to a first embodiment of the present invention. FIG. 2 is a cross-sectional view, taken from a line A-A, of the hydraulic pump illustrated in FIG. 1. The hydraulic pump illustrated in FIGS. 1 and 2 converts an engine rotation and a torque transmitted to a shaft 1 into an oil pressure and discharges the oil sucked from a suction port P1 from a discharge port P2 as highly-pressurized hydraulic oil. This hydraulic pump is a variable capacity hydraulic pump capable of freely varying a discharge amount of the hydraulic oil from the pump by changing a tilt angle a of a swash plate 3.

Hereafter, an axis which extends along an axis of the shaft 1 is referred to as an X-axis, an axis which extends along a tilt-center axis that is a line connecting fulcrums when tilting the swash plate 3 is referred to as a Z-axis, and an axis which is orthogonal to the X-axis and the Z-axis is referred to as a Y-axis. A direction which extends from an input-side end portion toward an opposite-side end portion of the shaft 1 is referred to as an X-direction.

The hydraulic pump includes the shaft 1, a cylinder block 6, and the swash plate 3. The shaft 1 is rotatably supported by a case 2 and an end cap 8 via bearings 9*a* and 9*b*. The cylinder block 6 is connected to the shaft 1 via a spline structure 11 and is driven to be rotated integrally with the shaft 1 in the case 2 and the end cap 8. The swash plate 3 is provided between a side wall of the case 2 and the cylinder block 6. Provided in the cylinder block 6 are a plurality of piston cylinders (cylinder bores 25) disposed at regular intervals in a circumferential direction around the axis of the shaft 1 and parallel to the axis of the shaft 1. Pistons 5 capable of reciprocating parallel to the axis of the shaft 1 are inserted through the plurality of cylinder bores 25.

A spherical concave sphere is provided at an end of each piston 5 protruding from each of the cylinder bores 25. A spherical convex portion of a shoe 4 fits into the spherical concave portion, and thus, each piston 5 and each shoe 4 form a spherical bearing. The spherical concave portion of the piston 5 is caulked to prevent a separation from the shoe 4.

The swash plate 3, at its side facing the cylinder block 6, has a flat sliding surface S. Each shoe 4 slides in a circular pattern or elliptically while being pressed on this sliding surface S along with rotation of the cylinder block 6 which is linked to rotation of the shaft 1. Provided around the axis of the shaft 1 are a spring 15, a movable ring 16, a needle 17, and a ring-shaped pressing member 18. The spring 15 is supported by a ring 14 provided on an inner periphery, at the X-direction side, of the cylinder block 6. The movable ring 16 and the needle 17 are pressed by this spring 15. The pressing member 18 contacts the needle 17. The shoe 4 is pressed by this pressing member 18 to the sliding surface S.

Two hemispherical bearings 20 and 21 protruding to the swash plate 3 side are provided on the side wall of the case 2 and at symmetric positions with reference to the axis of the shaft 1. On the other hand, two concave spheres are formed on the swash plate 3 at the side wall side of the case 2 and at portions corresponding to the positions where the bearings 20 and 21 are disposed. By making the bearings 20 and 21 contact the two concave spheres of the swash plate 3, a bearing of the swash plate 3 is formed. These bearings 20 and 21 are disposed in the Z-axis direction.

As illustrated in FIG. 2, the swash plate 3 tilts around a line which is an axis (parallel to the Z-axis) connecting the bearings 20 and 21 and within a plane orthogonal to an X-Y plane. The tilt of the swash plate 3 is determined by a piston 10 reciprocating while pressing, from the side wall side of the case 2, an end of the swash plate 3 along the X-direction. The swash plate 3 is tilted by the reciprocation of the piston 10 with respect to a line connecting the bearings 20 and 21 as a fulcrum. The sliding surface S is also tilted by the tilt of the swash plate 3, and the cylinder block 6 is rotated with a rotation of the shaft 1. For example, as illustrated in FIGS. 1 and 2, when a tilt angle relative to an X-Z plane is a, and when the cylinder block rotates in a counterclockwise direction viewed in the X-direction, each shoe 4 slides on the sliding surface S in a circular or elliptical pattern, and along with this, the piston 5 reciprocates in each of the cylinder bores 25.

When the piston 5 moves to the swash plate 3 side, the oil is sucked into the cylinder bore 25 from the suction port P1 via a valve plate 7. When the piston 5 moves to the valve plate 7 side, the oil which is highly-pressurized hydraulic oil in the cylinder bore 25 is discharged from the discharge port P2 via the valve plate 7. By adjusting the tilt of the swash plate 3, a volume of hydraulic oil discharged from the discharge port P2 is controlled variably.

[Configurations of Valve Plate and Cylinder Block]

Figure 3:
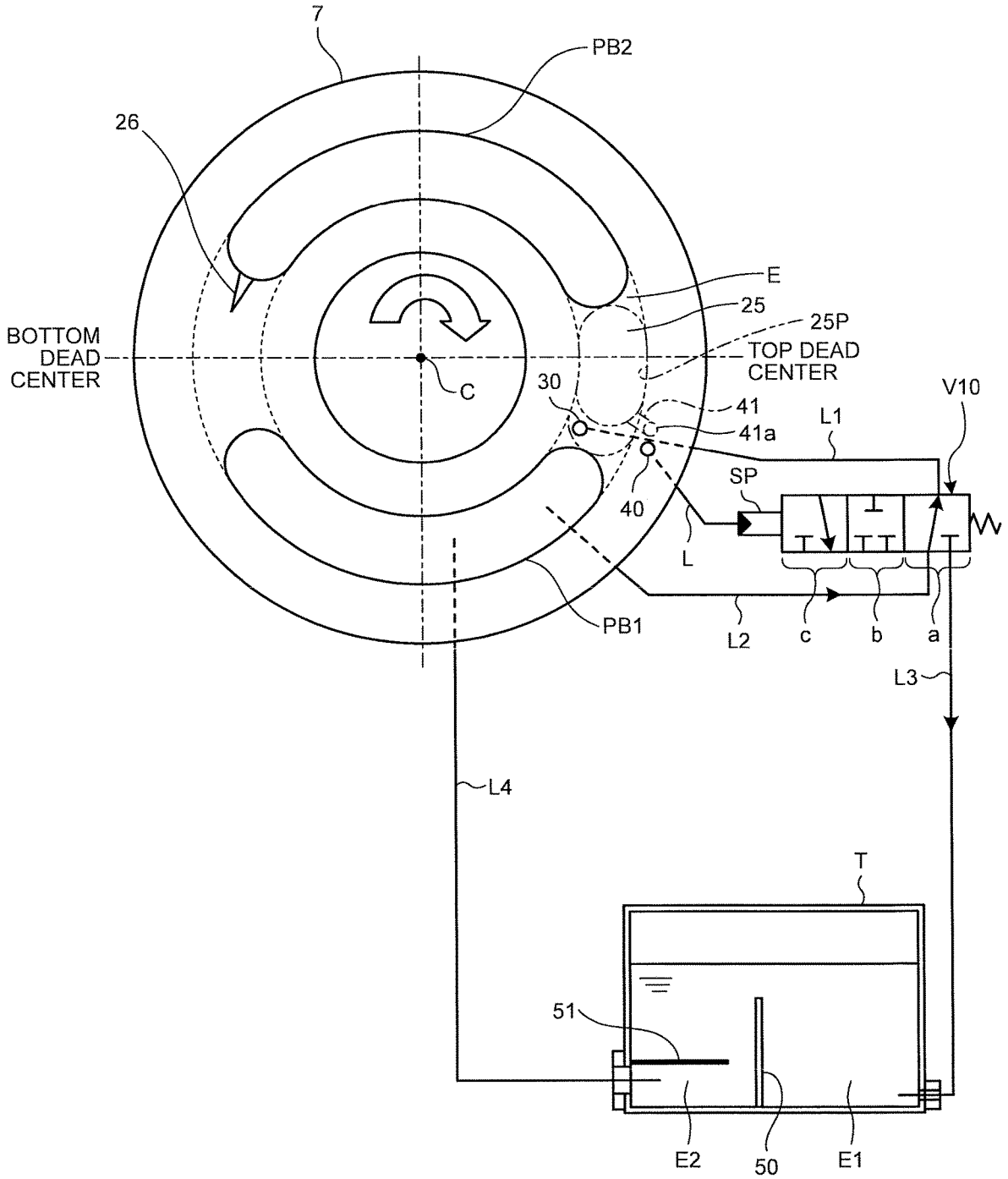
FIG. 3 is a cross-sectional view taken from a line B-B of the hydraulic pump illustrated in FIG. 1 and is a view illustrating a cross section of a hydraulic oil tank connected to the hydraulic pump.
Figure 4:
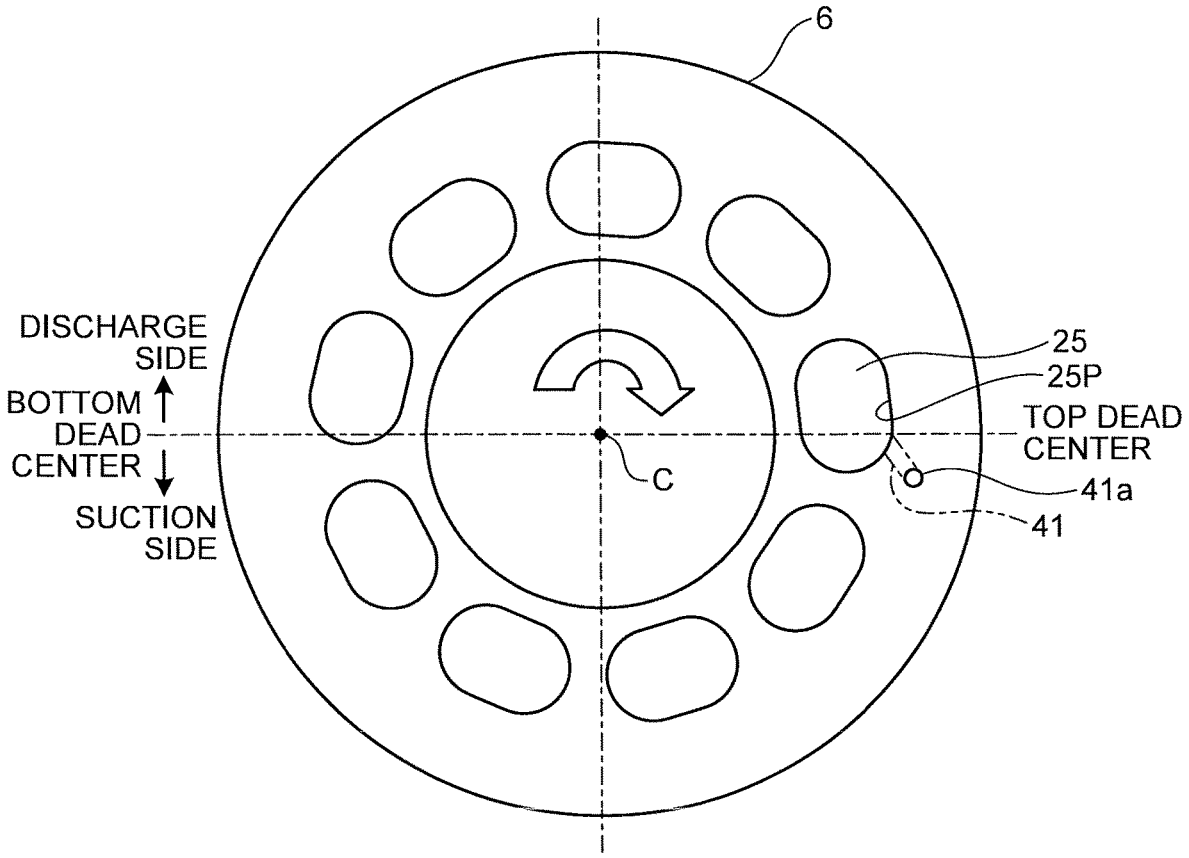
FIG. 4 is a view, in a −X-direction, of a configuration illustrating a sliding surface, relative to the valve plate, of the cylinder block.

Herein the valve plate 7 fixed to the end cap 8 side contacts the rotatable cylinder block 6 via a sliding surface Sa. FIG. 3 is a cross-sectional view, taken from a line B-B, of the hydraulic pump illustrated in FIG. 1. FIG. 4 is a view illustrating a configuration, viewed in a −X-direction, of the sliding surface Sa of the cylinder block 6 relative to the valve plate 7. An end surface, at the sliding surface Sa side, of the valve plate 7 and an end surface, at the sliding surface Sa side, of the cylinder block 6 illustrated in FIGS. 3 and 4 slide with each other by the rotation of the cylinder block 6.

As illustrated in FIG. 3, the valve plate 7 has a valve plate suction port PB1 communicating with the suction port P1 and a valve plate discharge port PB2 communicating with the discharge port P2. The valve plate suction port PB1 and the valve plate discharge port PB2 are provided on the same circular arc and form cocoon shapes extending in a circumferential direction. On the other hand, as illustrated in FIG. 4, provided at the sliding surface Sa side of the cylinder block 6 are ports (cylinder ports 25P) for the nine cylinder bores 25, in each of which each piston 5 reciprocates on the same circular arc on which the valve plate suction port PB1 and the valve plate discharge port PB2 are disposed at regular intervals and in the cocoon shapes.

Herein, in FIGS. 3 and 4, when the cylinder block 6 rotates in the clockwise direction viewed in a direction toward the −X-direction, a discharge process is supposed to be conducted at the valve plate discharge port PB2 side at an upper side of FIG. 3, and a suction process is supposed to be conducted at the valve plate suction port PB1 side at a lower side of FIG. 3. Therefore, in this case, the right end side of FIG. 3 is switched from the discharge process to the suction process and it is a top dead center at which the piston 5 in the cylinder bore 25 enters the sliding surface Sa side the most deeply, and an inside of the cylinder bore 25 transmits from a high-pressure state to a low-pressure state. On the other hand, a left end side of FIG. 3 is switched from the suction process to the discharge process and it is a bottom dead center at which the piston 5 in the cylinder bore 25 is separated from the sliding surface Sa side the most. When the cylinder port 25P passes this bottom dead center, the low-pressure state is supposed to be transmitted to the high-pressure state.

As illustrated in FIG. 3, a notch 26 is provided on the valve plate 7. The notch 26 is provided on extend from an end, at the bottom dead center side, of the valve plate discharge port PB2 to the bottom dead center side. The notch 26 serves as a pressure regulating restriction prior to communication of the cylinder bore 25 with the valve plate discharge port PB2. By providing this notch 26, immediately prior to the communication of the cylinder bore 25 with the valve plate discharge port PB2, a pressure in the cylinder bore 25 becomes closer to a pressure at the valve plate discharge port PB2 gently. As a result of this, erosion and noise at the cylinder bore 25 are restrained when the cylinder bore 25 communicates with the valve plate discharge port PB2.

As illustrated in FIG. 3, a residual pressure release port 30 is provided on the valve plate 7. The residual pressure release port 30 is provided in a rotation transition area E of the cylinder port 25P and in an area reaching the valve plate suction port PB1 in the vicinity of, and from, the top dead center. The residual pressure release port 30 is provided at the position where the residual pressure release port 30 can communicate with the cylinder bore 25 prior to the cylinder bore 25 communicating with the valve plate suction port PB1.

[Configuration of Residual Pressure Acquisition Portion]

A residual pressure detection port 40 is provided on the valve plate 7. The residual pressure detection port 40 is provided outside the rotation transition area E of the cylinder port 25P and in an area reaching the valve plate suction port PB1 in the vicinity of, and from, the top dead center.

On the other hand, as illustrated in FIG. 4, provided on the cylinder block 6 is a residual pressure port 41 making the cylinder bore 25 communicate with the residual pressure detection port 40. As illustrated in FIG. 3, a residual pressure port opening 41*a* is provided at the sliding surface Sa side and so that the residual pressure port opening 41*a* makes a rotational movement on a circumference that is identical to the residual pressure detection port 40 in radius. That is, the residual pressure detection port 40 communicates with the residual pressure port 41 once per a rotation of the cylinder block 6. Since an opening, at the sliding surface Sa side, of the residual pressure detection port 40 is provided outside the rotation transition area E of the cylinder port 25P, the opening, at the sliding surface Sa side, of the residual pressure detection port 40 is blocked by the cylinder block 6 in a state in which the residual pressure detection port 40 does not communicate with the residual pressure port 41. As a result of this, while the cylinder block 6 makes one rotation, a residual pressure in the cylinder bore 25 when the residual pressure detection port 40 communicates with the residual pressure port 41 is maintained.

The residual pressure detection port 40 may be provided at outside the rotation transition area E of the cylinder port 25P, or may be alternatively provided inside of the rotation transition area E. The number of the residual pressure port 41 is not limited to one, and a plurality of residual pressure ports 41 may be provided, for example, by the number of those of the cylinder bores 25. Moreover, a plurality of residual pressure ports 41 may be provided on one cylinder bore 25.

It is preferable that the residual pressure detection port 40, the residual pressure port 41, and the residual pressure release port 30 be disposed respectively so that the cylinder bore 25 communicates with the residual pressure release port 30 after the communication between the residual pressure detection port 40 and the residual pressure port 41 finishes.

Herein, the residual pressure detection port 40 and the residual pressure port 41 described above serve as a residual pressure acquisition portion obtaining a value of a residual pressure in the cylinder bore 25 by an actual measurement while the cylinder bore 25 on the top dead center side communicates with the valve plate suction port PB1 in the vicinity of, and from, the top dead center.

[Directional Switching Valve]

Herein a directional switching valve V10 is connected to the residual pressure release port 30, the residual pressure detection port 40, the valve plate suction port PB1, and a hydraulic oil tank T. The residual pressure release port 30 is connected to the directional switching valve V10 via a flow path L1. The residual pressure detection port 40 is connected to the directional switching valve V10 via a flow path L. The valve plate suction port PB1 is connected to the directional switching valve V10 via a flow path L2. The hydraulic oil tank T is connected to the directional switching valve V10 via a flow path L3.

The directional switching valve V10 uses a residual pressure maintained in the residual pressure detection port 40 as a control signal pressure for moving a spool SP. The directional switching valve V10 switches, making use of this movement of the spool, between a flow path between the residual pressure release port 30 and the valve plate suction port PB1 and a flow path between the residual pressure release port 30 and the hydraulic oil tank T.

Figure 5:
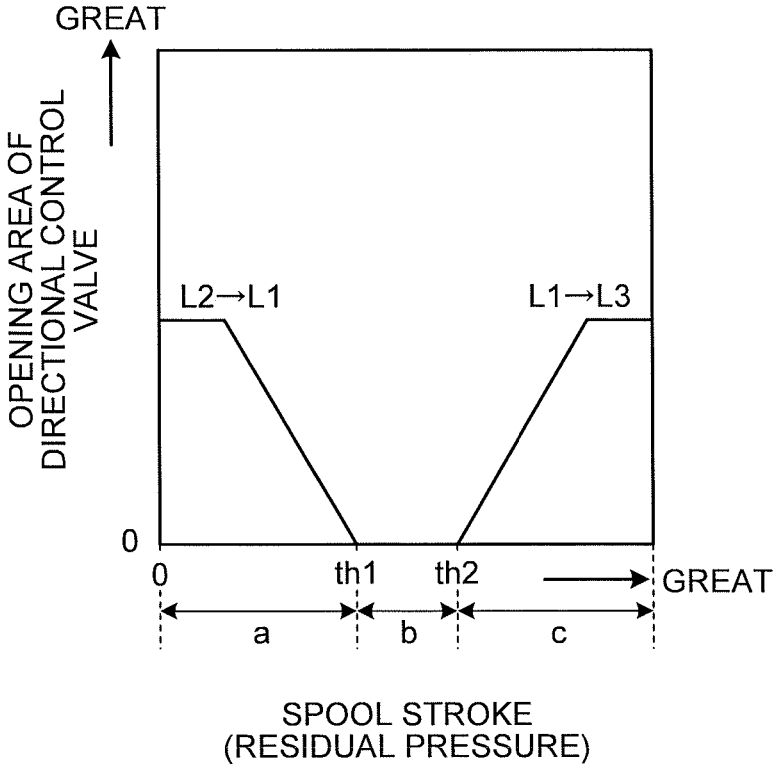
FIG. 5 is a view illustrating a relationship between a spool stroke and an opening area of a directional switching valve illustrated in FIG. 3.

As illustrated in FIG. 5, the directional switching valve V10 is configured to increase a spool stroke along with an increase in the detected residual pressure. The directional switching valve V10 conducts a flow rate control as well of opening a flow path between the residual pressure release port 30 and the valve plate suction port PB1 when the detected residual pressure is less than a predetermined value th1 (in a case of an area a) and decreasing a flow rate along with a decrease in the residual pressure. In this state, a flow path between the residual pressure release port 30 and the hydraulic oil tank T is blocked. In this case, the hydraulic oil in the valve plate suction port PB1 flows into the cylinder bore 25 via the flow path L2, the flow path L1, and the residual pressure release port 30, the residual pressure in the cylinder bore 25 increases.

When the detected residual pressure is between the predetermined value th1 and a predetermined value th2 (in a case of an area b), the directional switching valve V10 blocks both the flow path between the residual pressure release port 30 and the hydraulic oil tank T and the flow path between the residual pressure release port 30 and the valve plate suction port PB1.

Moreover, the directional switching valve V10 conducts a flow rate control as well of opening the flow path between the residual pressure release port 30 and the hydraulic oil tank T when the detected residual pressure is greater than the predetermined value th2 (in a case of an area c) and increasing a flow rate along with an increase in the residual pressure. In this state, the flow path between the residual pressure release port 30 and the valve plate suction port PB1 is blocked. In this case, the hydraulic oil compressed in the cylinder bore 25 flows into the hydraulic oil tank T via the residual pressure release port 30, the flow path L1, and the flow path L3, the residual pressure in the cylinder bore 25 decreases.

Figure 6:
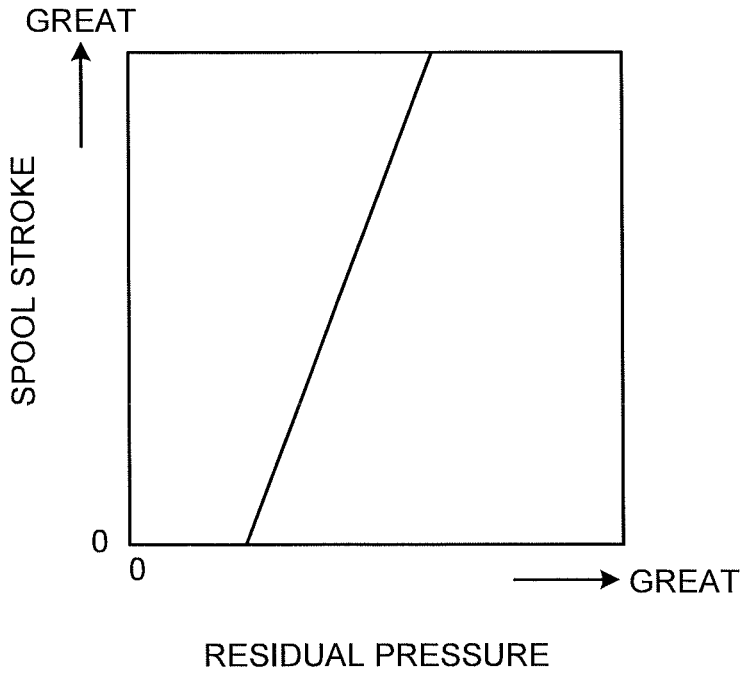
FIG. 6 is a view illustrating a relationship between a residual pressure and the spool stroke of the directional switching valve illustrated in FIG. 3.

As illustrated in FIG. 6, a relationship is proportional between the residual pressure and the spool stroke.

Provided in the hydraulic oil tank T is a partition plate 50 separating the hydraulic oil in areas E1 and E2 disposed in a horizontal direction. The hydraulic oil containing more air and being in the cylinder bore 25 flows into the area E1 via the flow path L3. The hydraulic oil is supplied from the area E2 via a flow path L4 to the valve plate suction port PB1 side. An air in the hydraulic oil flowing into the area E1 is removed in the area E1. The hydraulic oil which is cleansed, where air in the area E1 is reduced, flows into the area E2 via an upper portion of a partition plate 50. A blocking plate 51 extending horizontally above a port, from which the hydraulic oil flows out, is provided in the area E2. By providing this blocking plate 51, the cleansed hydraulic oil not containing a precipitating dust or the like is supplied to the valve plate suction port PB1 side.

Since the residual pressure in the cylinder bore 25 is measured by using the residual pressure detection port 40 and the residual pressure port 41 in this first embodiment, a highly-accurate residual-pressure control can be conducted. For example, when the residual pressure in the cylinder bore 25 is high, the residual pressure can be used as an assistance for the rotation. When the residual pressure in the cylinder bore 25 is low, it is possible to prevent the rotation from being restrained by increasing the residual pressure. The rotation efficiency is increased by the residual-pressure control. On the other hand, the residual pressure in the cylinder bore 25 can be decompressed smoothly when a process shifts from the discharge process to the suction process and until communicating with the valve plate suction port PB1. Therefore, when the cylinder bore 25 communicates with the valve plate suction port PB1, aeration is prevented from being produced. This reduces erosion and noise caused by the aeration.

Second Embodiment

Figure 7:
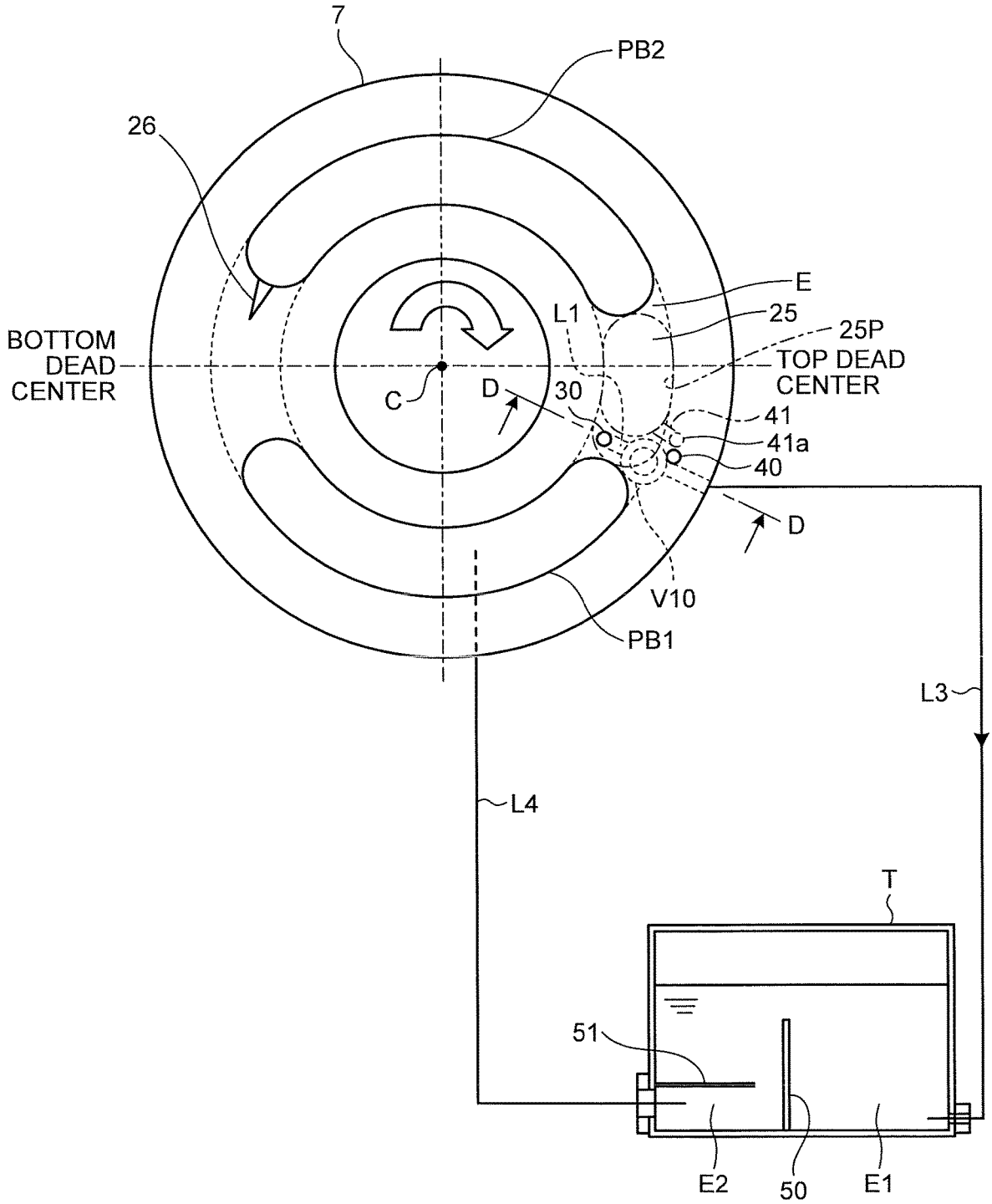
FIG. 7 is a schematic view illustrating a configuration of a second embodiment of the present invention.

In the second embodiment, as illustrated in FIG. 7, the directional switching valve V10 illustrated in the first embodiment is buried in the valve plate 7, and the directional switching valve V10 is integrated with the valve plate 7. The directional switching valve V10 is provided in the vicinity of the residual pressure detection port 40 and the residual pressure release port 30. Hereby, lengths of the residual pressure detection port 40 and the flow path L, the residual pressure release port 30 and the flow path L1, and the flow path L2 can be reduced.

[Configuration of Directional Switching Valve]

Figure 8:
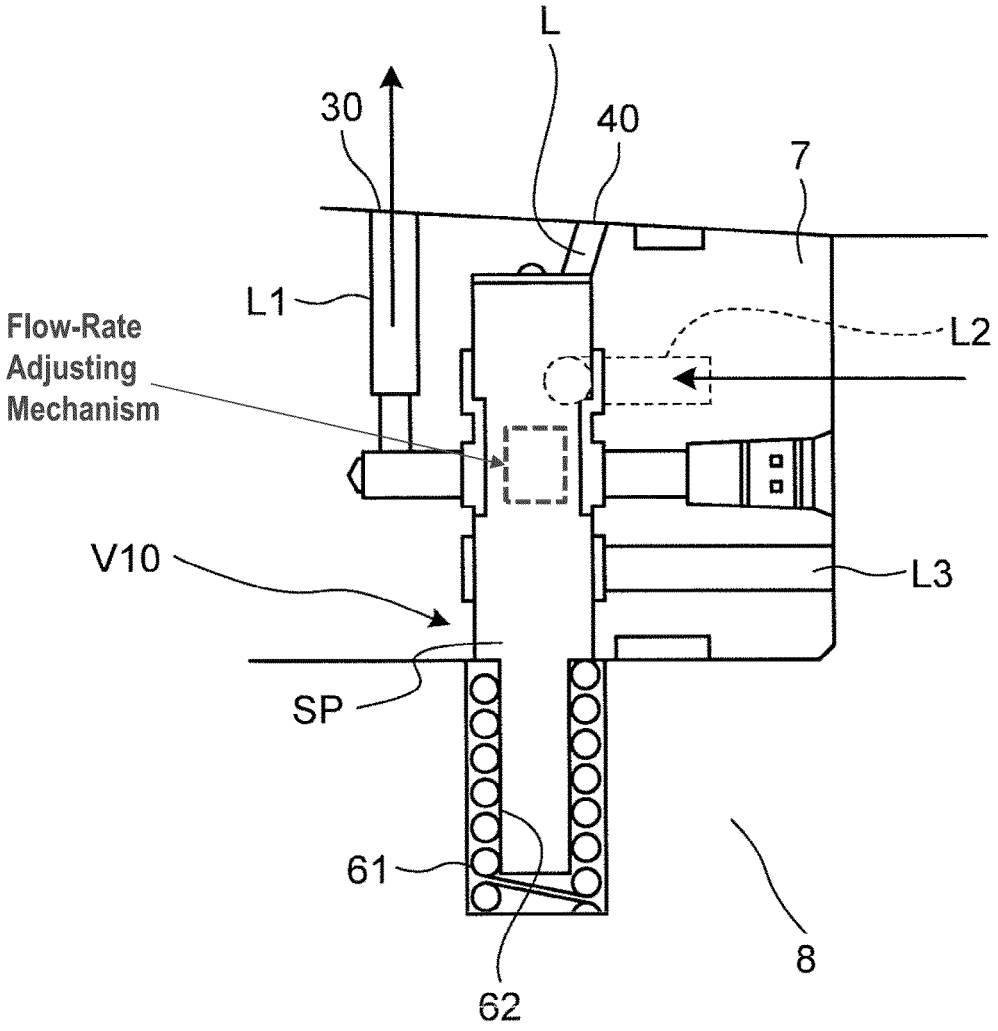
FIG. 8 is a cross-sectional view, taken from a line D-D, illustrating a configuration of a directional switching valve when the residual pressure is small.
Figure 9:
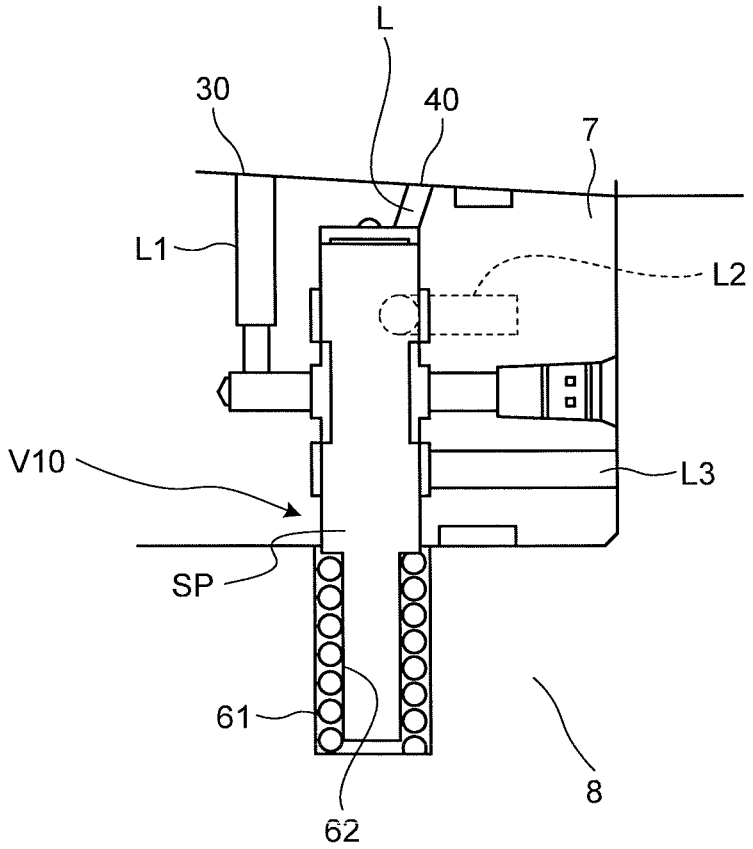
FIG. 9 is a cross-sectional view, taken from the line D-D, of the configuration of the directional switching valve when the residual pressure is medium.
Figure 10:
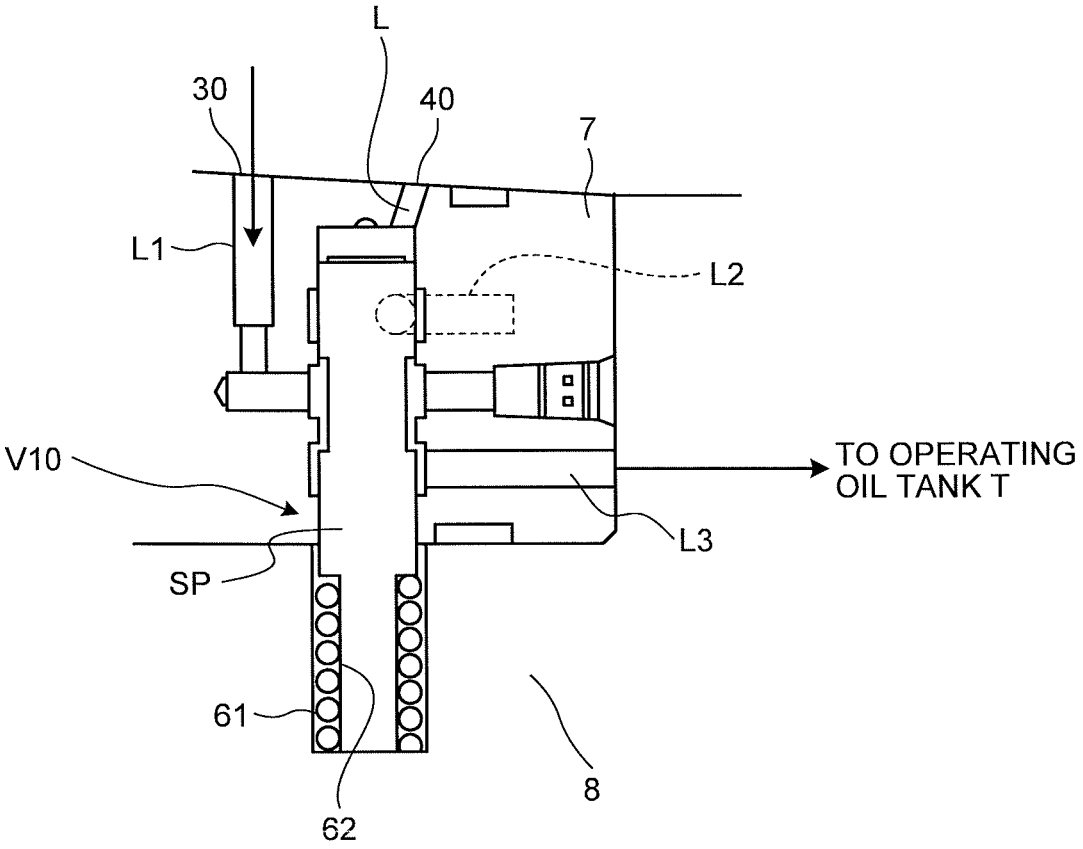
FIG. 10 is a cross-sectional view taken from the line D-D, of the configuration of the directional switching valve when the residual pressure is large.

FIGS. 8 to 10 are cross-sectional views taken from a line D-D and illustrating the configuration of the directional switching valve V10 illustrated in FIG. 7. FIG. 8 illustrates a configuration of the directional switching valve V10 when the residual pressure is small. FIG. 9 illustrates a configuration of the directional switching valve V10 when the residual pressure is medium. Moreover, FIG. 10 illustrates a configuration of the directional switching valve V10 when the residual pressure is great.

As illustrated in FIG. 8, the residual pressure detection port 40 communicates with an upper portion of the spool SP. An insertion hole 61 is provided in an end cap 8 in a lower direction of the spool SP, and a helical spring 62 is fitted along an inner periphery of the end cap 8. An end of the spool SP is inserted into the helical spring 62. The spool SP stops at a position where the residual pressure maintained by the residual pressure detection port 40 is in balance with a pressing force of the helical spring 62.

Since the residual pressure is small in FIG. 8, the spool SP moves to an upper side (residual pressure detection port 40 side) by the pressing force of the helical spring 62. In this state, an opening is formed between the flow path L2 and the flow path L1. As a result, the hydraulic oil from the valve plate suction port PB1 flows to the residual pressure release port 30 side. Hereby, the residual pressure in the cylinder bore 25 approaches a pressure of the valve plate suction port PB1. The flow paths L1 and L3 are blocked from each other.

When the residual pressure is middle as illustrated in FIG. 9, an opening between the flow paths L1 and L2 and an opening between the flow paths L1 and L3 are not formed. As a result, the flow paths L1 and L2 are in a state of being blocked from each other, and the flow paths L1 and L3 are in a state of being blocked from each other.

When the residual pressure is great as illustrated in FIG. 10, the spool SP is pressed to the helical spring 62 side by the residual pressure. In this state, an opening is formed between the flow paths L1 and L3. As a result, the hydraulic oil in the cylinder bore 25 flows into the hydraulic oil tank T via the residual pressure release port 30. Hereby, the residual pressure in the cylinder bore 25 decreases. The flow paths L1 and L2 are blocked from each other.

Third Embodiment

In this third embodiment, the residual pressure in the cylinder bore 25 is estimated based on a relationship between a swash plate angle D1 of the swash plate 3, a rotation speed D2 of the shaft 1, a discharge pressure D3 from the valve plate discharge port PB2, and a hydraulic oil temperature D4 of the valve plate discharge port PB2; and the residual pressure in the cylinder bore 25, and thus the directional switching valve V10 is configured to be controlled by this estimated residual pressure. Since the residual pressure is estimated in this third embodiment, the residual pressure detection port 40 and the residual pressure port 41 are not provided.

Figure 11:
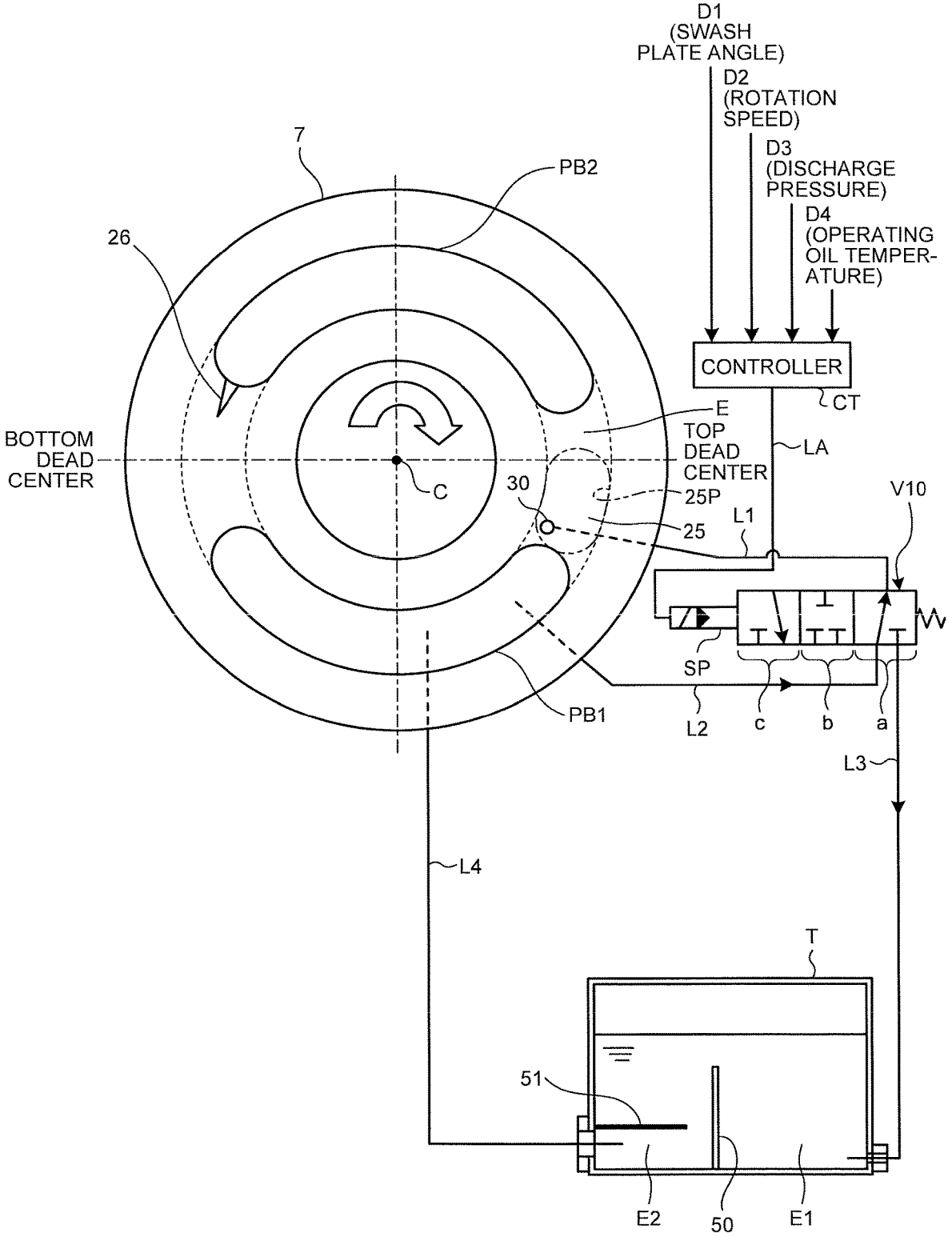
FIG. 11 is a schematic view illustrating a configuration of a third embodiment of the present invention.
Figure 12:
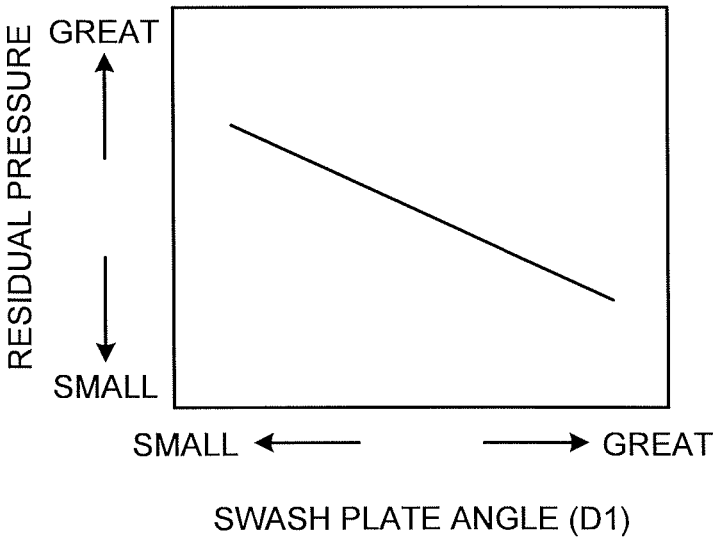
FIG. 12 is a view illustrating a relationship between a swash plate angle and a residual pressure.
Figure 13:
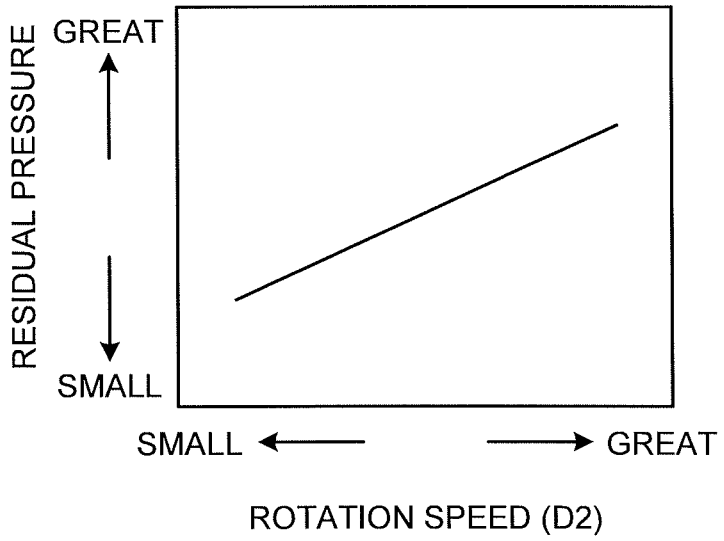
FIG. 13 is a view illustrating a relationship between a rotation speed and the residual pressure.
Figure 14:
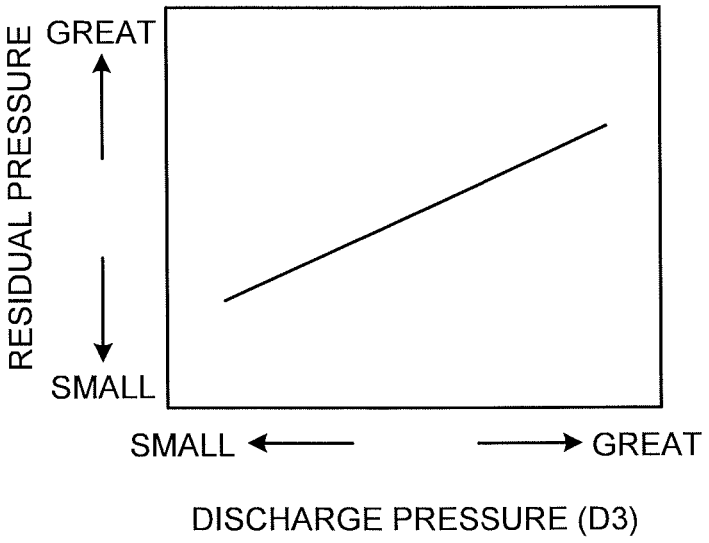
FIG. 14 is a view illustrating a relationship between a discharge pressure and the residual pressure.
Figure 15:
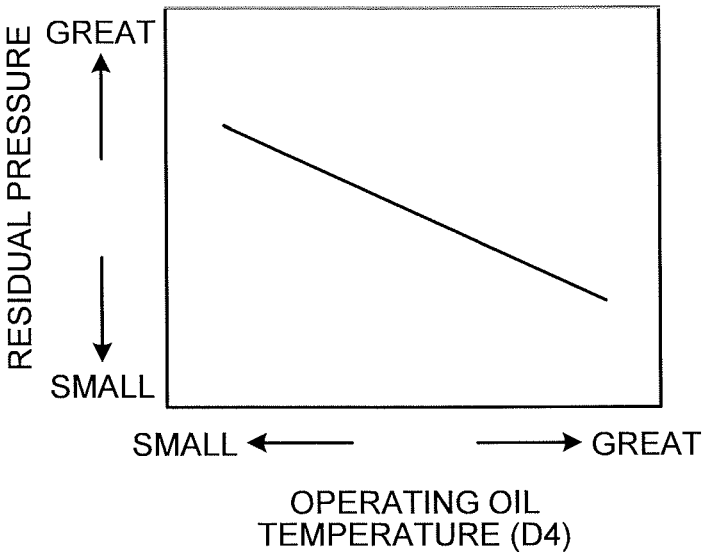
FIG. 15 is a view illustrating a relationship between a hydraulic oil temperature and the residual pressure.

FIG. 11 is a schematic view illustrating a configuration of the present third embodiment. As illustrated in FIG. 11, the swash plate angle D1, the rotation speed D2, the discharge pressure D3, and the hydraulic oil temperature D4 described above are inputted to a controller CT. The swash plate angle D1 is obtained by obtaining a stroke amount by a reciprocation of the piston 10 (see FIG. 2). The rotation speed is obtained by a rotation speed sensor 100 (see FIG. 2). The discharge pressure D3 is obtained by a pressure sensor 103 (see FIG. 1). The hydraulic oil temperature D4 is obtained by a temperature sensor 104 (see FIG. 1).

Based on the relationship between the swash plate angle D1, the rotation speed D2, the discharge pressure D3, and the hydraulic oil temperature D4; and the residual pressure illustrated in FIGS. 12 to 15, the controller CT estimates the residual pressure of the hydraulic pump in a current state. Although relationships of the swash plate angle D1, the rotation speed D2, the discharge pressure D3, and the hydraulic oil temperature D4, relative to the residual pressure are illustrated in FIGS. 12 to 15 respectively, the estimated residual pressure is obtained according to a five-dimensional map for the swash plate angle D1, the rotation speed D2, the discharge pressure D3, the hydraulic oil temperature D4, and the residual pressure. Not all of detected information for the swash plate angle D1, the rotation speed D2, the discharge pressure D3, and the hydraulic oil temperature D4 may not be used, and equal to or greater than one detected information may be used.

The controller CT outputs a control signal corresponding to the estimated residual pressure to the directional switching valve V10 via a communication line LA. The directional switching valve V10 controls an electromagnetic valve or the like based on the control signal inputted from the controller CT to control the stroke of the spool SP.

The directional switching valve V10, by controlling the spool stroke, conducts switching, blocking, and flow-rate controlling between a flow path between the flow paths L1 and L3 and a flow path between the flow paths L1 and L2 similarly to the first and the second embodiments.

Figure 16:
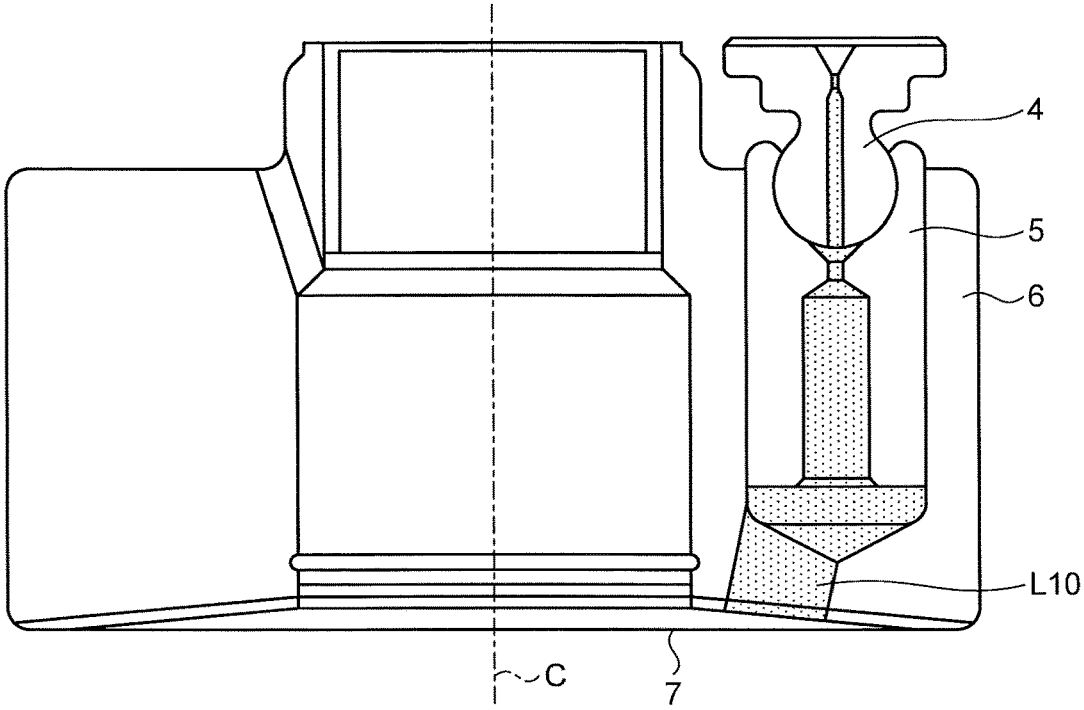
FIG. 16 is a cross-sectional view illustrating a state in a cylinder bore when the swash plate angle is at maximum.

For example, when the swash plate angle D1 is great, the controller CT estimates that the residual pressure is small because, as illustrated in FIG. 16, a residual pressure oil amount L10 is small and thus it takes little time to extract the residual pressure. Since it takes little time as well to extract the residual pressure when the rotation speed D2 is small, the controller CT estimates that the residual pressure is small. When the discharge pressure D3 is small, since the hydraulic oil of its discharge pressure D3 flows into the cylinder bore 25, the controller CT estimates that the residual pressure is small. When the hydraulic oil temperature D4 is great (high), since the density of the hydraulic oil is low and the viscosity of the hydraulic oil is low as well, and thus it takes little time to extract the residual pressure, the controller CT estimates that the residual pressure is small.

Figure 17:
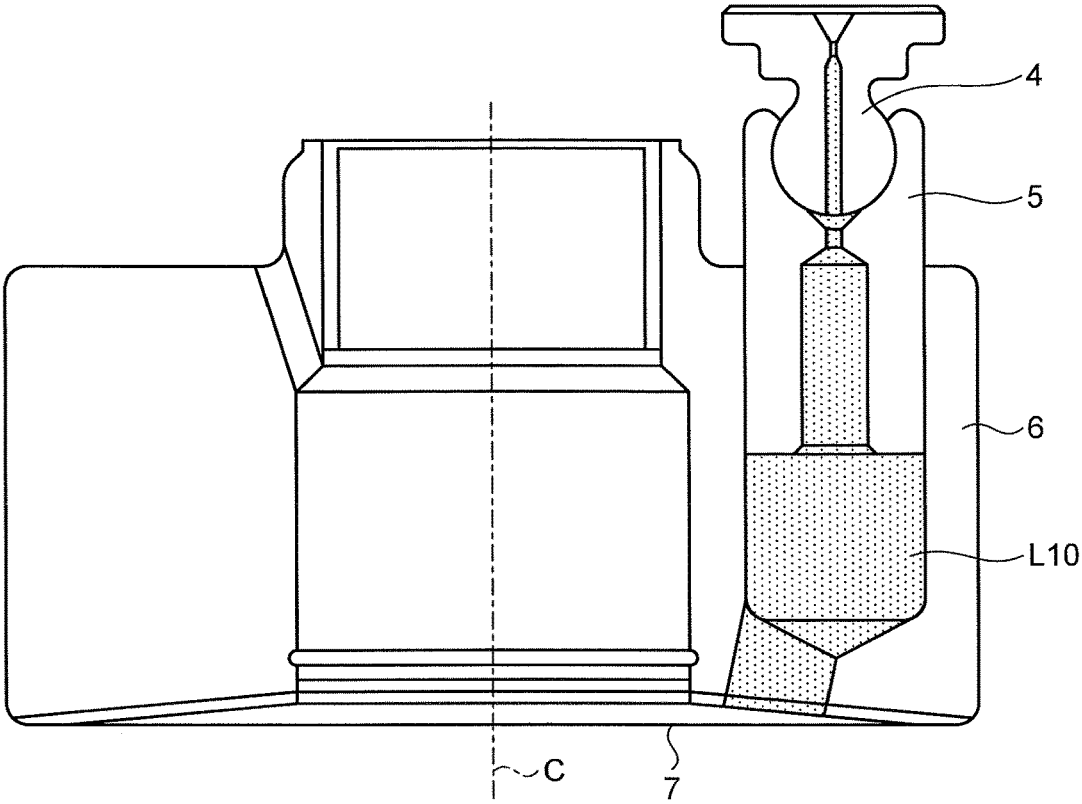
FIG. 17 is a cross-sectional view illustrating a state in the cylinder bore when the swash plate angle is at minimum.

On the other hand, when the swash plate angle D1 is small, since the residual pressure oil amount L10 is great as illustrated in FIG. 17, and thus it takes time to extract the residual pressure, the controller CT estimates that the residual pressure is great. Since it takes time to extract the residual pressure when the rotation speed D2 is great as well, the controller CT estimates that the residual pressure is great. When the discharge pressure D3 is great, since the hydraulic oil of its discharge pressure D3 flows into the cylinder bore 25, the controller CT estimates that the residual pressure is great. When the hydraulic oil temperature D4 is small (low), since the density of the hydraulic oil is high and the viscosity of the hydraulic oil is high as well, and thus it takes time to extract the residual pressure, the controller CT estimates that the residual pressure is great.

A portion detecting the stroke amount of the reciprocation of the piston 10, the rotation speed sensor 100, the pressure sensor 103, the temperature sensor 104, and the controller CT serve a residual pressure acquisition portion for obtaining the residual pressure in the cylinder bore 25 by estimation.

Although the present invention explained according to the above-described first to third embodiments is not limited to an example of using the hydraulic pump, and may be applied to use a hydraulic motor. In a case of the hydraulic motor, a high-pressure side is supposed to correspond to a discharge side of the hydraulic pump and a low-pressure side is supposed to correspond to a suction side of the hydraulic pump.

Moreover, although the present invention explained according to the above-described first to third embodiments is not limited to an example of using the swash-plate hydraulic pump motor, and may be applied to use an inclined-shaft-type hydraulic pump-motor.

REFERENCE SIGNS LIST

1 shaft
2 case
3 swash plate
4 shoe
5, 10 piston
6 cylinder block
7 valve plate
8 end cap
9*a*, 9*b* bearing
11 spline structure
14 ring
15 spring
16 movable ring
17 needle
18 pressing member
20, 21 bearing
25 cylinder bore
25P cylinder port
26 notch
30 residual pressure release port
40 residual pressure detection port
41 residual pressure port
41*a* residual pressure port opening
50 partition plate
51 blocking plate
61 insertion hole
62 helical spring
100 rotation speed sensor
103 pressure sensor
104 temperature sensor
CT controller
D1 swash plate angle
D2 rotation speed
D3 discharge pressure
D4 hydraulic oil temperature
L, L1 to L4 flow path
LA communication line
P1 suction port
P2 discharge port
PB1 valve plate suction port
PB2 valve plate discharge port
S, Sa sliding surface
SP spool
T hydraulic oil tank
V10 directional switching valve

The invention claimed is:

1. An axial hydraulic pump-motor, in which a cylinder block, having a plurality of cylinder bores formed around a rotational shaft, slides on a valve plate having a high-pressure side port and a low-pressure side port for controlling an amount of reciprocation of a piston in each of the cylinder bores based on a tilt of a swash plate, the hydraulic pump-motor comprising:

a residual pressure release port provided on the valve plate and configured to communicate with a cylinder bore, from the plurality of cylinder bores, which is on a top dead center side, the residual pressure release port communicating with the cylinder bore until the cylinder bore communicates with the low-pressure side port;

a residual pressure acquisition portion configured to receive a representative pressure of a residual pressure in the cylinder bore on the top dead center while the cylinder bore on the top dead center side communicates with the low-pressure side or to obtain an estimated value of the residual pressure; and a directional switching valve configured to switch and block a flow path between the residual pressure release port and a hydraulic oil tank and a flow path between the residual pressure release port and the low-pressure side port based on the representative pressure received by the residual pressure acquisition portion or the estimated value of the residual pressure obtained by the residual pressure acquisition portion.

2. The hydraulic pump-motor according to claim 1, wherein the directional switching valve is configured to adjust a flow-rate therethrough.

3. The hydraulic pump-motor according to claim 1, wherein the residual pressure acquisition portion comprises:

a residual pressure port provided on the cylinder block, the residual pressure port having an opening outside a rotation transition area of a cylinder bore from the plurality of cylinder bores, and the residual pressure port communicating with an inside of the cylinder bore; and a residual pressure detection port provided on the valve plate, the residual pressure detection port communicating with the residual pressure port temporarily via the opening of the residual pressure port along with a rotation of the cylinder block for detecting and maintaining the residual pressure in the cylinder bore on the top dead center side, wherein the directional switching valve switches and blocks a flow path based on pressure maintained by the residual pressure detection port.

4. The hydraulic pump-motor according to claim 3, wherein the directional switching valve is integrally formed in the valve plate.

5. The hydraulic pump-motor according to claim 1, wherein the residual pressure acquisition portion is a detecting portion detecting one or more values of at least one of a swash plate angle, a rotation speed, a discharge pressure, and a hydraulic oil temperature, and is a controller estimating the residual pressure in the cylinder bore on the top dead center side based on the one or more values and generating the control signal pressure of the directional switching valve based on the estimated residual pressure.

6. The hydraulic pump-motor according to claim 1, wherein when the received representative pressure or the estimated value of the residual pressure is greater than a first predetermined value, the directional switching valve makes the residual pressure release port and the hydraulic oil tank communicate therebetween, when the received representative pressure or the estimated value of the residual pressure is between the first predetermined value and a second predetermined value which is less than the first predetermined value, the directional switching valve blocks the flow path between the residual pressure release port and the hydraulic oil tank and blocks the flow path between the residual pressure release port and the low-pressure side port, and when the received representative pressure or the estimated value of the residual pressure is less than the second predetermined value, the directional switching valve makes the residual pressure release port communicate with the low-pressure side port.

* * * * *